US008859873B2

(12) United States Patent
Ghozali

(10) Patent No.: US 8,859,873 B2
(45) Date of Patent: Oct. 14, 2014

(54) SYSTEM AND APPARATUS FOR PLAYING AN ANGKLUNG MUSICAL INSTRUMENT

(76) Inventor: Kasim Ghozali, Jakarta Selatan (ID)

( * ) Notice: Subject to any disclaimer, the term of this patent is extended or adjusted under 35 U.S.C. 154(b) by 59 days.

(21) Appl. No.: 13/515,590

(22) PCT Filed: Dec. 16, 2010

(86) PCT No.: PCT/ID2010/000010
§ 371 (c)(1),
(2), (4) Date: Jun. 18, 2012

(87) PCT Pub. No.: WO2011/073963
PCT Pub. Date: Jun. 23, 2011

(65) Prior Publication Data

US 2012/0247303 A1 Oct. 4, 2012

(30) Foreign Application Priority Data

Dec. 17, 2009 (ID) ..... P00220900675

(51) Int. Cl.
*A63H 5/00* (2006.01)
*G04B 13/00* (2006.01)
*G10H 7/00* (2006.01)

(52) U.S. Cl.
USPC ..... 84/609; 84/102

(58) Field of Classification Search
USPC ..... 84/609, 2–4, 102, 105–107
See application file for complete search history.

(56) References Cited

U.S. PATENT DOCUMENTS

| | | | | |
|---|---|---|---|---|
| 3,229,021 | A * | 1/1966 | Baschet | 84/723 |
| 4,271,742 | A | 6/1981 | Sakashita et al. | |
| 5,266,732 | A * | 11/1993 | Suzuki | 84/103 |
| 5,471,006 | A * | 11/1995 | Schwartz et al. | 84/609 |
| 6,417,439 | B2 * | 7/2002 | Uehara et al. | 84/645 |
| 6,750,388 | B2 * | 6/2004 | McKasah | 84/600 |
| 2012/0318116 | A1 * | 12/2012 | Meeks et al. | 84/103 |

OTHER PUBLICATIONS

Prof. Dr. Godfried-Willem Raes, Klung an automated anklung, XP002621678, http://logosfoundation.org/instrum_gwr/klung.html, Dec. 19, 2012.
Prof. Dr. Godfried-Willem Raes, Klung PIC board circuit, XP002621679, http://logosfoundation.org/instrum_gwr/klung/SCH-Klung-Picboard.gif, Dec. 19, 2012.

(Continued)

*Primary Examiner* — Jeffrey Donels
(74) *Attorney, Agent, or Firm* — Brooks Kushman P.C.

(57) ABSTRACT

A system and an apparatus to play an Angklung musical instrument automatically consisting of hardware and software. The hardware consists of Angklung, two vertical poles, horizontal pole to hang Angklungs, bottom supporting frame which is equipped with an actuator supporting frame, the actuator is in the form of electric motor mounted on the actuator supporting frame connected in a cross-sectional position with each Angklung, an eccentric disk which is equipped with eccentric shaft, vibrator sleeves for connecting the electric motor with an Angklung, controller device consisting of the controller driver and the flow controller as a track storage and regulator of pulses of electrical current that would flow to the electric motor. The software installed on the computer that consists of an interface program to download, remove, save or record the songs stored on the controller device, and other programs to write songs.

18 Claims, 6 Drawing Sheets

(56) References Cited

OTHER PUBLICATIONS

Ruslan, Mahasiswa Stikom Surabaya Ciptakan Angklung Otomatis, XP002621680, http://www.antaranews.com/berita/1255093952/mahasiswa-stikom-surabaya-ciptakan-angklung-otomatis, Dec. 19, 2012.

Google Translate, Surabaya STIKOM Students create automatic Angklung, XP002621681, http://translate.google.de/tranlate?js=n&prev=t&hl=en&ie-UTF-8&layout=2&eotf=1&sl=auto&tl=en&u=http%3A%2F%2Fwww.antaranews.com%2Fberita%2F1255093952%2Fmahasiswa-stikom-surabaya-ciptakan-angklung-otomatis, Dec. 19, 2012.

Steven Patrick, Teens 'Rap' to robotics, XP002621682, http://archives.thestar.com.my/news/story/asp?file=/2010/2/23itfeature/5429618&sec=itfeature, Dec. 19, 2012.

PCT International Search Report Dated Jan. 3, 2011, Applicnat PT EMAX Fortune International, Application No. PCT/ID/2010/000010.

PCT International Preliminary Report on Patentability Dated Jun. 1, 2012, Applicant PT EMAX Fortune Interntional, Application No. PCT/ID/2010/000010.

* cited by examiner

SYSTEM AND APPARATUS FOR PLAYING AN ANGKLUNG MUSICAL INSTRUMENT

CROSS-REFERENCE TO RELATED APPLICATION

This application is the U.S. national phase of PCT Appln. No. PCT/ID2010/000010 filed on Dec. 16, 2010, which claims priority to ID Patent Application No. P00220900675 filed on Dec. 17, 2009, the disclosures of which are incorporated in their entirety by reference herein.

FIELD OF INVENTION

This invention relates to a system and an apparatus designed to play an Indonesian origin of musical instrument called "Angklung", more particularly it relates to a system of software and hardware that assembled into a device for generating sound out from an Angklung musical instrument.

BACKGROUND OF THE INVENTION

Angklung is a musical instrument from West Java, and has been recognized widely by the public in Indonesia. Physically, Angklung is a musical instrument made of bamboo trunk in which the sound is generated from air resonance due to the vibration at the internode of bamboo trunk. The size of the internode of bamboo trunk produces sound with a frequency that represents a particular tone. Therefore, an Angklung musical instrument usually is a series of several sections of bamboo internode to produce a variety of tones that covers the notes in a song.

An Angklung that represents a note usually consists of two sections of bamboo internode of different sizes in length but have the same kind of tone. The length is designed to determine the high and low tones. Thus, in general, an Angklung can produce sound of a note with a combination of high and low tone frequencies.

Angklung tones usually correspond the musical scales in general, ie. pentatonic and diatonic scales. Pentatonic scales consist of five notes per octave, whereas diatonic scales consist of seven notes in one octave. The addition of the octave, in principle, is a repetition of notes composition at each scale of note. Therefore, the number of Angklungs corresponds to the number of notes, both in diatonic and pentatonic scales, which are required to play a song. Generally the notes required are more than one octave.

Unfortunately, playing Angklung by a single player cannot produce musical sounds perfectly, especially to play three notes at the same time (chord). In order to play a song perfectly, more than one person or a group of Angklung players are required. In addition, to date there is no instrument that is able to play Angklung automatically and to replace the human role. Therefore, it is required to invent a device for playing an Angklung musical instrument automatically.

SUMMARY OF THE INVENTION

The purpose of this invention is to overcome the human limitations in playing Angklung musical instruments. This invention uses a set of hardware and software configured in such a way so as to be able to play an Angklung musical instrument. The device consists of a DC electric motor functioning as a vibrating actuator of Angklung; series of controller comprising various microcontrollers, mosfet and optocoupler. The hardware is connected with a power supply and a computer.

The software according to the present invention is a computer program such as notepad to write notes of a song. The notes of the songs that have been written then are stored in a memory using an interface of Visual Basic (VB) program. Aside of storage for song data, the interface program is also designed to display the control panel of the device, digitally.

This apparatus will work upon command to play a song that has been stored in the memory. The command is given through the interface program that is displayed in the form of panels on a computer screen. Furthermore, the actuator will move and vibrate the Angklung and automatically play selected songs.

DETAILED DESCRIPTION OF THE INVENTION

This invention includes an apparatus that plays an Angklung musical instrument (A) which consists of hardware controlled by software installed on the computer. The hardware and software is configured in such a way that it can play an Angklung musical instrument independently. The embodiment of this invention can be described with reference in FIG. 1 to FIG. 6.

<Hardware>

Figure 1:
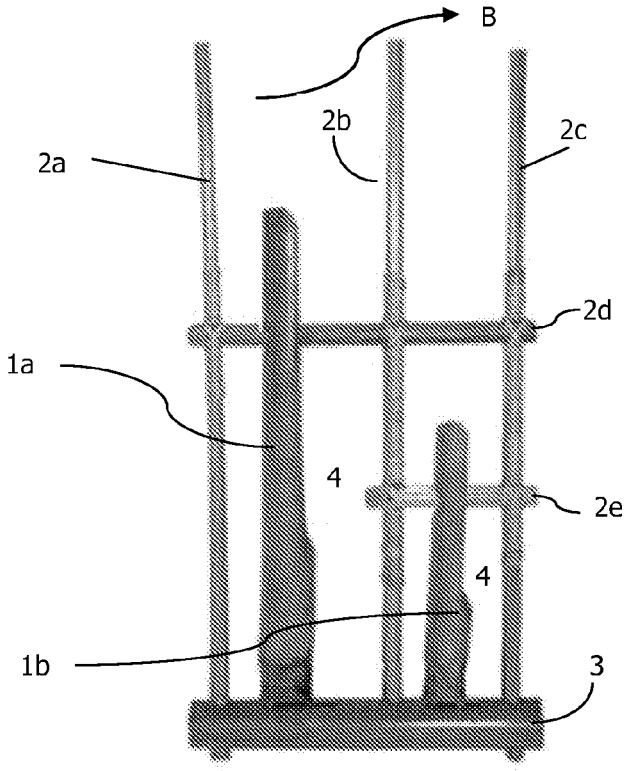
FIG. 1 is an Angklung that produce one type of note.

Referring to FIG. 1, an Angklung (B) consists of two internodes of bamboo trunk (1*a* and 1*b*) attached to a bamboo structure that consists of three vertical poles (2*a*, 2*b* and 2*c*), two horizontal poles (2*d* and 2*e*), and a base (3). The vertical poles (2*a*, 2*b* and 2*c*), are plugged in the base (3) thus forming the two planes (4) for the internodes of bamboo trunk (1*a* and 1*b*). Internodes of bamboo trunk (1*a* and 1*b*) are placed on each plane (4) where the top part is hung on horizontal poles (2*d* and 2*e*). As explained above a Angklung (B) produces a certain note as it vibrates.

Figure 2:
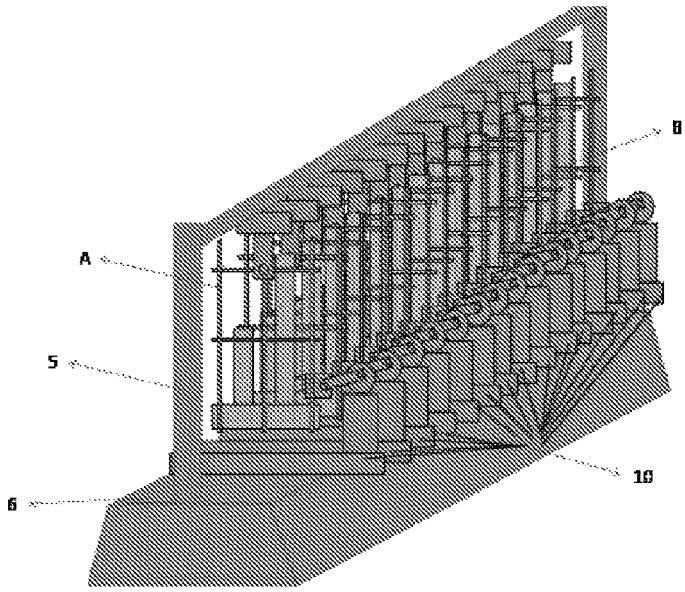
FIG. 2 are Angklungs arranged into several octave of musical scales placed on a supporting frame.

FIG. 2 shows that a series of Angklungs having a variety of notes in accordance with certain musical scales. Each Angklung (B) is hung on a supporting frame (5) to facilitate in playing them. Angklung supporting frame is established in an Angklung supporting box (6). The number of Angklungs placed on the supporting frame (5) is adjusted to the need to cover a range of notation of a song starting from the lowest note to highest one.

Figure 3:
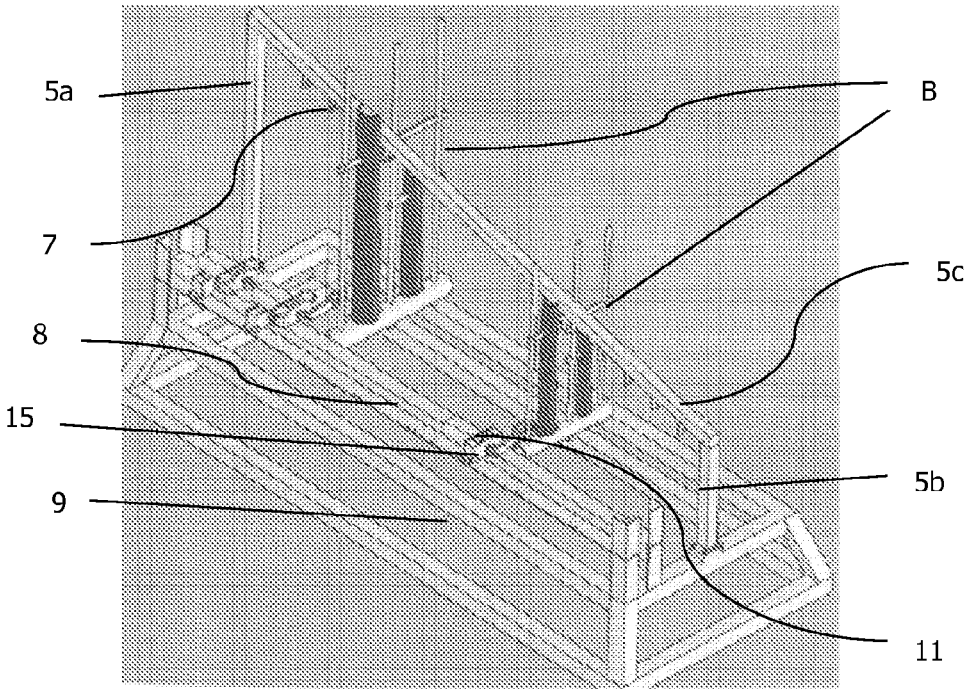
FIG. 3 is an Angklung supporting frame.

Referring to FIG. 3, the supporting frame (5) will be explained in more detail. Angklung supporting frame (5) consists of a top supporting frame, bottom supporting frame (9) and actuator supporting frame (8). The top supporting frame (5) is made of a metal rod frame mounted on the bottom part. The top supporting frame (5) consists of three parts: two vertical poles mounted on both sides (5*a* and 5*b*) of the frame structure connected with a horizontal pole (5*c*) mounted on both vertical poles. The horizontal pole (5*c*) serves as a place to hold the Angklungs (B). The vertical poles (5*a* and 5*b*) are of different height so that the horizontal pole (5*c*) mounted on one ends look leaning toward another end when viewed from the side. The slope of the horizontal pole (5*c*) is designed to match the sizes of the Angklungs (B). Horizontal pole (5*c*) has a supporting segment (7) that keeps the Angklungs remained in place. The construction according to this invention is not limited to such arrangement. It is possible to use other constructions and materials that result in the same effect to the present invention. For example, supporting frame can be made of wood, plastic, aluminum, metal or other suitable materials.

The bottom supporting frame (9) can be of a metal frame as in the top supporting frame. Further, the bottom supporting frame (9) is covered by timber so as to form a box. Alternatively, the entire bottom is made of wood so that its construction resembles a box with no bottom supporting frame. The bottom supporting frame (9) serves both as a supporting pole of the top of the frame, the actuator supporting frame (8), as well as a box for storage for other components of the Angklung vibrator according to the invention. These components include electrical cables (10) and so forth. The construction and material of bottom supporting frame according to this invention are not limited to such construction and material.

Figure 4:
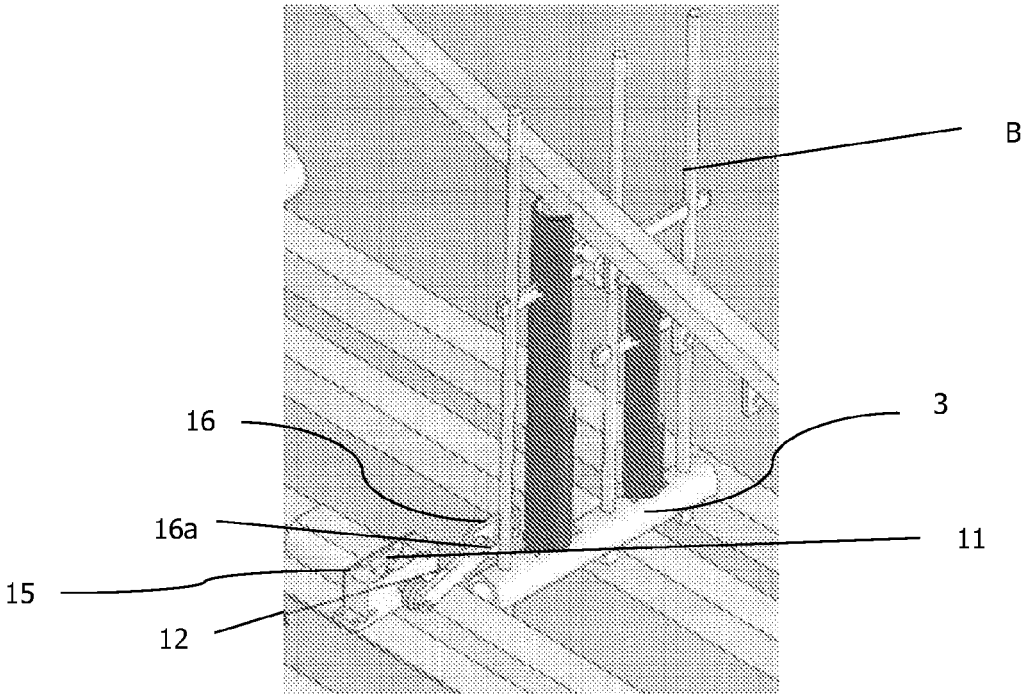
FIG. 4 is a mechanical system according to this invention where the actuator is connected with an Angklung.

FIG. 4 shows the construction details in which an Angklung (B) is connected with the actuator. Firstly, actuator, in which in the present invention is in the form of electric motors (11), is mounted on the actuator supporting frame at a cross-sectional position towards the Angklung. Referring to FIG. 4, the electric motors (11) is connected to the actuator housing (15) mounted on an actuator supporting frame (8). Electric motors (11) serve as an actuator that vibrates Angklung (B). Electric motors (11) are made in such arrangement that the number of them correspond to the number of Angklungs (B) mounted on the top supporting frame. Actuator housing (15) is attached to the supporting frame by a fastening bolt (not shown) such that the actuator (8) cannot shift from its place. Actuator housing has a hole through which the electric motor shaft (11*a*) passes so that the end position resides outside of the actuator housing (15). The electric motor (11) is accommodated in the electric motor housing so that it cannot shift.

Figure 5:
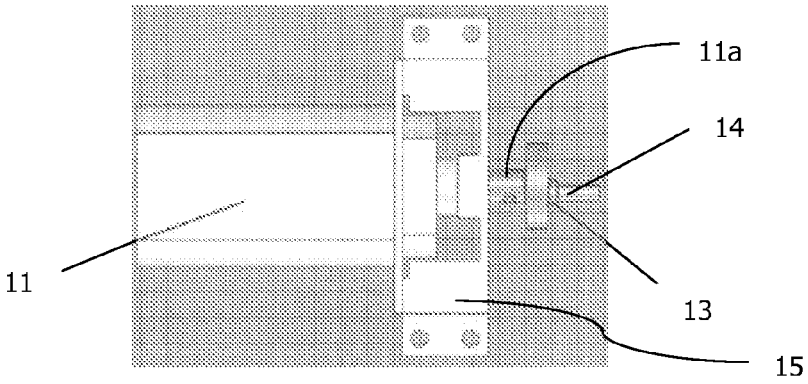
FIG. 5 is an electric motor that serves as an actuator/vibrator of Angklung.

The electric motor (11) mounted on the frame can be explained by referring to FIG. 5. At the end of the electric motor shaft (11*a*) that protrudes out an eccentric disk (13) is mounted. Eccentric disc is equipped with a cam that serves as an eccentric shaft (14) in the form of a rod attached to the disk surface facing outward. Eccentric shaft (14) has a distance from the electric motor shaft (11*a*) or the midpoint of the eccentric disk (13) approximately 1 mm to 5 mm and more preferably of 2.5 mm. Furthermore, the eccentric shaft (14) connected with a vibrator plate (16), which has a hook cam (16*a*), which includes one end of the base (3) on Angklungs (B) through a vibrator arm (12). Vibrator arm (12) has two holes, one hole to insert the eccentric shaft (14) and the other hole to insert the hook cam (16*a*).

Thus, when the electric motor (11) is operated the rotation of eccentric disk (13) moving along with the rotation of the shaft (11*a*) will move the vibrator arm (12) so that the Angklungs (B) will vibrate as they are being played by humans. Thus, the sound generated by each vibrated Angklung (B) then composed into a particular song. In this case, the electric motor (11) as the actuator is equipped with a cable to connect it to the controllers (C), which will supply the electrical current. In this invention it is preferable that the rotation of electric motor (11) is more than 7 RPS (420 rpm) up to a maximum of 10 RPS (600 rpm). However, this invention is most effective at 9 rps rotation (540 rpm).

Figure 6:
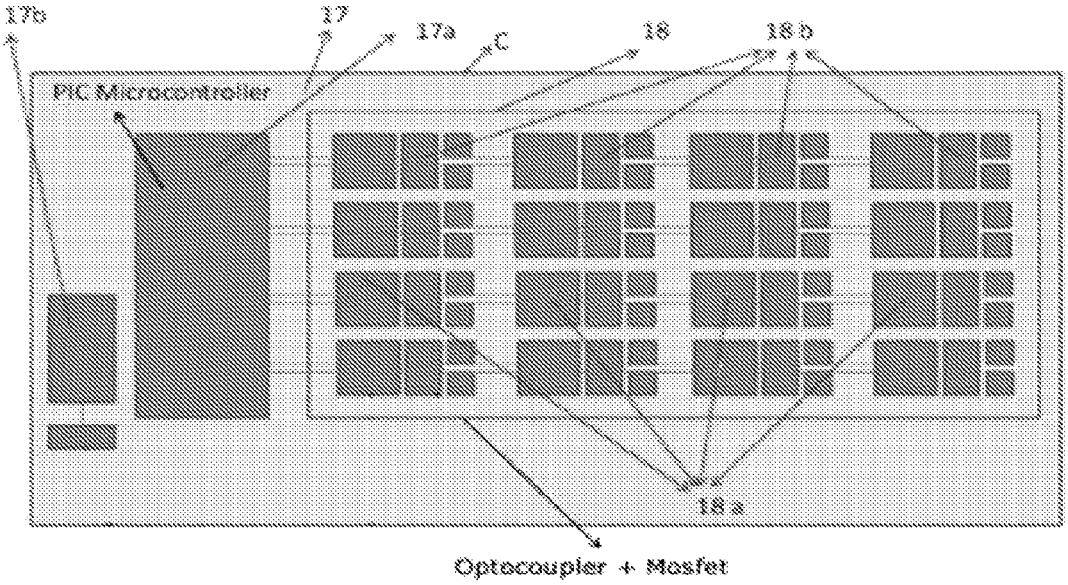
FIG. 6 is a scheme of controller circuit that regulates the electricity current toward the electric motor.

Another hardware is a controller (C), which will be explained in more detail in FIG. 6. Controller device (C) is a series of electronic components that logically consists of the controller driver (17) and the current controller (18). Section controller driver (17) serves to control the driver of the electric motor (11), whereas the current controller (18) serves to separate the current that will be used by the controller driver (17) and current that will be used by the electric motor (11). The components contained in the controller driver (17), among others microcontroller PIC (Peripheral Interface Controller) (17*a* and 17*b*) and several other electronic components such as capacitor, transistor and so forth. Current control part (18) consists of an optocoupler (18*a*) and mosfet (18*b*) are arranged in such a manner as shown in FIG. 6.

PIC microcontroller used in this invention is a PIC 16F877A type. Optocoupler (18*a*) used in this invention is a 4N28 type. Mosfet (18*b*) used in this invention is the IRFZ44N type. However, this invention is not limited only to the use of these components mentioned above. It is possible to use other electronic members in accordance with the purpose and objective of this invention.

Figure 7:
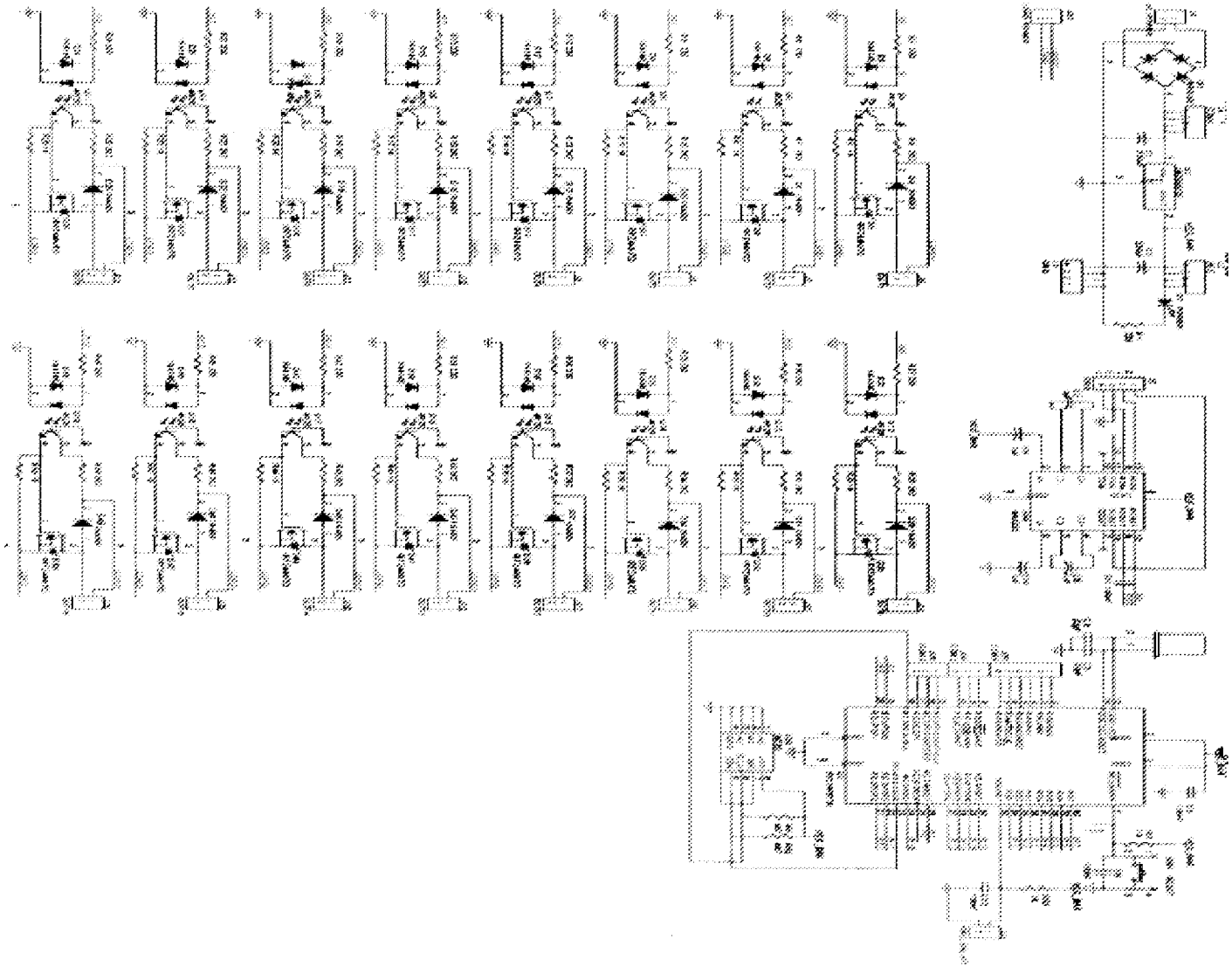
FIG. 7 is scheme of the controller.

The working procedure of the controllers (C) is as follows. The electric current from the power source (26) that have been reduced its voltage by a transformer (not shown) flowing into the controller (C) is then governed by the current controller (18) to be distributed to the controller driver (18) and the electric motor (11). In this arrangement mosfet (18*b*) plays an important role as an electronic switch that has a rapid response to control the output pulse of microcontroller PIC (17*a* and 17*b*) and can convey high current (up to a maximum 15 A) to drive the electric motor (11). The complete lay out of the electronic components of the controller device (C) can be seen from the scheme of control circuit devices (C) as shown in FIG. 7.

Controller device (C) is equipped with various additional components such as a serial port (19); display screen (20) in the form of LCD screens, and three buttons namely: the reset button (21), the power button (22), button 1 (23) and button 2 (24). Serial port (19) serves to connect the device for playing Angklung (A) according to this invention with a computer. Display screen (20) function to display and control the electronic data recorded on the device (A). The buttons (21, 22, 23, and 24) serves to turn on the device, and other functions such as downloading and the removal of the songs recorded on a controller (C).

Figure 10:
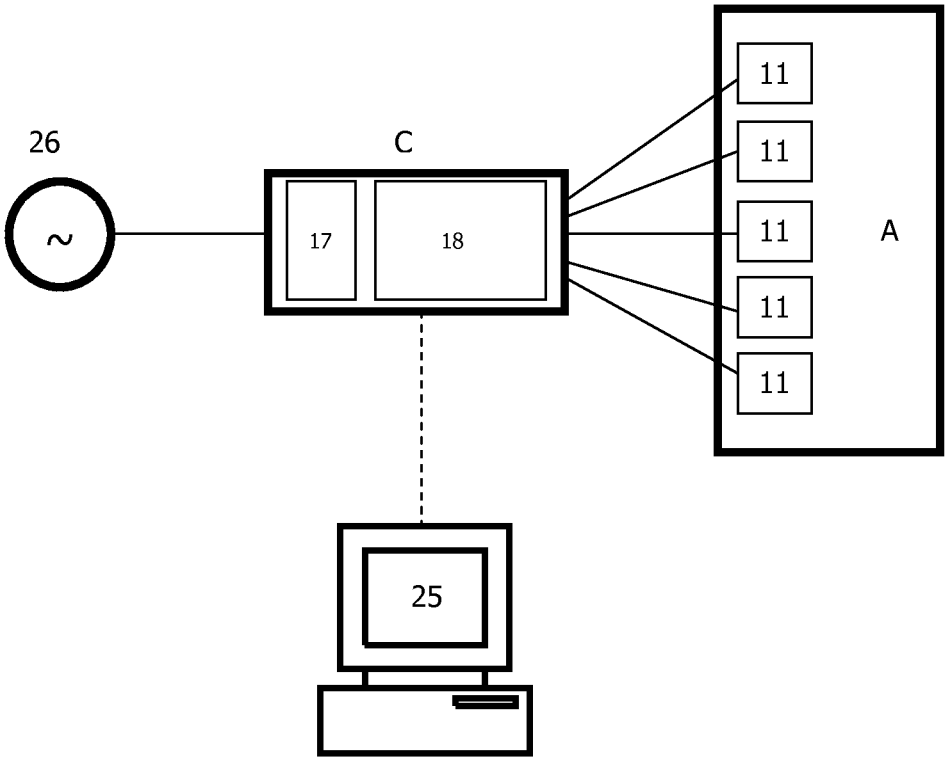
FIG. 10 is a scheme of the system that plays Angklung automatically.

In short, the apparatus which can play an Angklung musical instrument according to this invention is a system consisting of hardware and software as shown in FIG. 10. Current of electricity from the power source (26) that has been reduced its voltage by a transformer (not shown) flows into the controller (C). Controller device (C) then distributes the current to an electric motor (11) upon controller driver (17) command in the form of pulses. The said command work on the basis of written songs notation and stored in the microcontroller (17*a* and 17*b*) contained in the controller (C). The command is manifested by the current controller (18) in the form of electricity currents moving to the respective electric motor (11) designated by the notation of songs. Thus the Angklungs (B) will move in accordance with the notation of songs and then play a particular song.

<Software>

Figure 8:
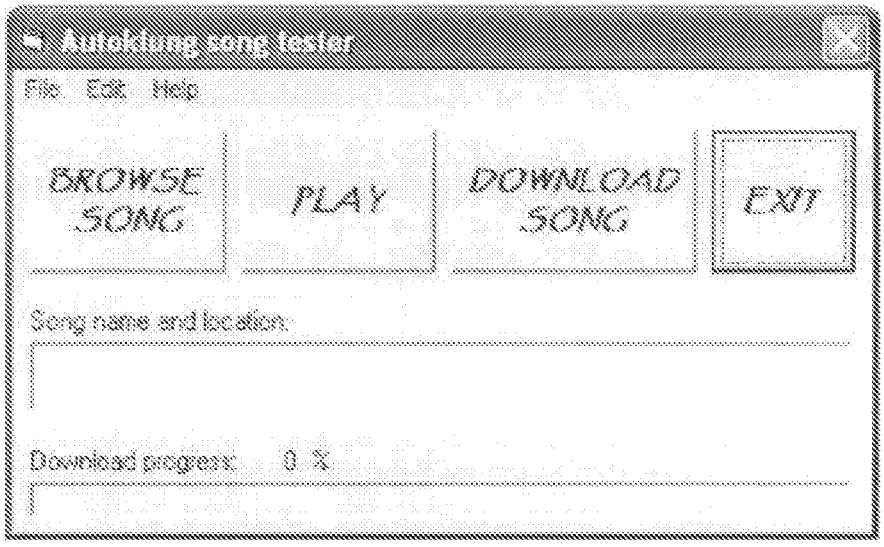
FIG. 8 is a visualization of interface program according to this invention.
Figure 9:
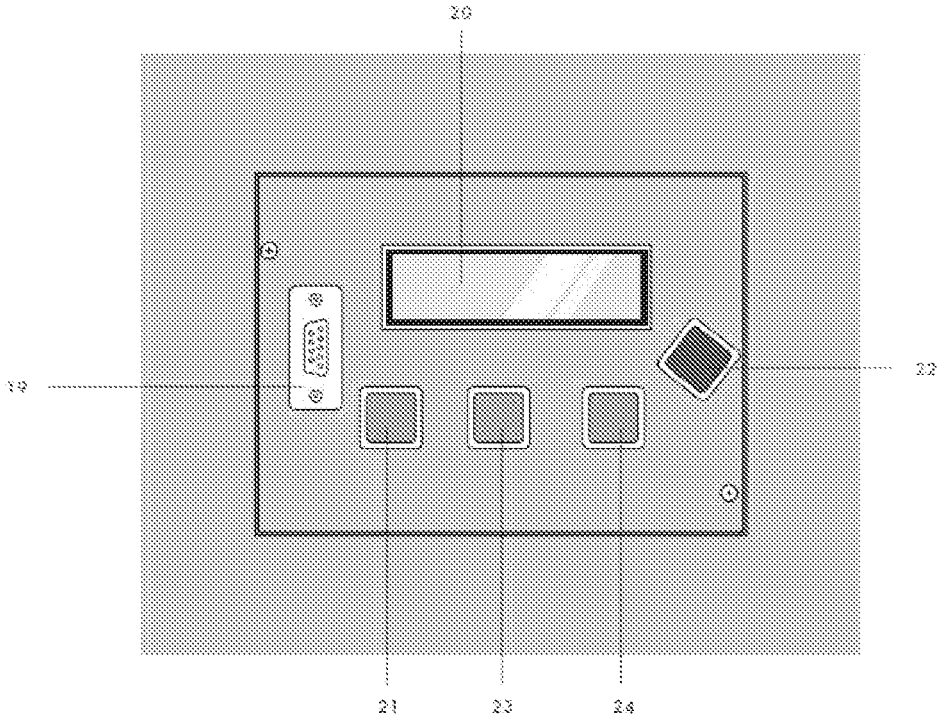
FIG. 9 is a display and control buttons on the controller device.

Another important part of the apparatus for playing the Angklung (A) according to this invention is software. The software in this case serves as a program control for the apparatus for playing the Angklung (A). The software can be visualized in an interface program that can be installed on the computer. More detailed explanation about interface program according to this invention will be explained on FIG. 8. FIG. 8 shows the interface program installed on the computer. The interface program is written in the form of a Visual Basic v6.0 computer programming language. However, this invention is not limited to the use of Visual Basic v6.0, it is possible to create a interface program with other computer programming languages as appropriate.

As having been stated above, the interface program installed on a computer. In this case the computer is hardware to facilitate downloading, removal, writing and editing of songs. Therefore, in addition to functioning as controller device for playing the Angklung (A) according to this invention, the interface program also serves as a means of downloading and removal of the songs recorded on the controller device (C). In the process of downloading and removal of songs, the computer must be connected to the controllers (C) through a serial port (19). However, in the writing and editing of songs, the computer is not required to connect to the controllers (C).

Referring to FIG. 8, the interface program is equipped with facilities of menu such as: browsing, play, download, exit, and so forth. However, this invention is not limited to these menu features. Addition of other features as desired for additional menu to the interface program according to this invention is possible.

<Songwriting>

In addition to software that has been described above, it requires another software to write a song. The song that is made for devices for playing the Angklung (A) according to the invention is written in the text used in the ordinary Notepad program included in Windows-based operating system. According to the invention the songwriting is done in a special way which will be explained in detail as follow.

The songwriting procedure according to this invention follows the standard values that apply in songs writing that consist of: tempo, note, octave and note value. In detail, each value is written with notation as follows:

Tempo:
- A: very slow;
- B: slow;
- C: moderate;
- D: fast; and
- E: very fast

Tone:
- Do: 1;
- Re: 2;
- Mi: 3;
- Fa: 4;
- Sol: 5;
- La: 6;
- Si: 7; and
- Silent tone: 0

Tone's Value
- ¼ tap: 1
- ½ tap: 2
- ¾ tap: 3
- 1 tap: 4
- 1½ tap: 5
- 2 tap: 6
- 3 tap: 7
- 4 tap: 8
- 6 tap: 9

Given the way in song writing as above does not recognize two digit notation, then to the tone that has a value above 6 tap the notations does not follow the number 10, 11, 12 and so on but is represented by a sign in the following table:

TABLE 1

| The symbol representing two-digit notation | | | |
|---|---|---|---|
| Notation 10 represented by : | Notation 11 represented by ; | Notation 12 represented by < | Notation 13 represented by = |
| Notation 14 represented by > | Notation 15 represented by ? | Notation 16 represented by @ | Notation 17 represented by A |

Octave:
- First Octave: 1
- The second octave: 2
- Third Octave 3

The composition of the writing of tone in Notepad is as follows:

Tempo

Note, Octave, Tone Count

For clear and practical purposes, the composition will be applied to a song with a tone as follows:

1 ̄2 3 4 5 ̄3

Written in Notepad with the composition:

A 1,1,5 2,1,2 3,1,4 4,1,4 5,1,5 3,1,2 1,1,6

In some songs there is a sign of silent or 0', the writing in a system of automatic Angklung (Autoklung) also uses the characters 0 or tone=0 with a value of octave also 0, but the tap value still correspond to the tap value of silent sign. Some songs have very high tap value. For example: 7 with a value of 4 taps, written as follows:

7,2,8, 7,2,@ means that one note 7 octave 2 with a value of 4 taps. Here the @ character represents the notation 16.

However, this invention is not limited to the manner and arrangement of the song in such way. It is possible to write songs on the apparatus to play an Angklung musical instrument automatically according to the invention by other way and use the text or other programming languages in accordance with the purposes of this invention.

The invention claimed is:

1. A system to play an Angklung musical instrument automatically consisting of:
- a hardware comprising,
- more than one Angklung,
- supporting frames where Angklungs and actuators are placed,
- an actuator including an electric motor having an eccentric disk mounted on a motor shaft, the eccentric disk having an eccentric shaft that is connected with an Angklung via a vibrator arm, the actuator further including a cable to connect it to the controller device,
- a controller device equipped with electronic components, power source, which serves to save the song and regulate the electric current to the actuator, and
- a computer device to facilitate the downloading, removal, writing and editing songs which is optionally connected to the controllers; and
- a software that is installed on a computer that consists of,
- an interface program to download, remove, save or record the songs stored on the controller device, and
- other programs to write songs,
- where the actuator is connected with a series of controller, which has recorded songs in the form of data of electronic text which is then translated into a series of commands on the controller to adjust the pulse of electrical current that drives the actuators.

2. A system to play an Angklung musical instrument automatically as in claim 1, where the data of songs to play is written in the form of text with Notepad programming language or other appropriate programming languages.

3. An apparatus for playing an Angklung musical instrument automatically consisting of:

more than one Angklung;

two vertical poles mounted on both sides of the apparatus;

horizontal pole placed at both ends of the vertical poles to hang Angklungs, a bottom supporting frame, to sustain over vertical poles, which is equipped with an actuator supporting frame;

electric motors mounted on the actuator supporting frame connected in cross-sectional position with each Angklung;

eccentric disks, which is mounted on the end electric motor shaft, which is equipped with eccentric shaft connected with a hole at one end of the vibrator arm;

vibrator arms, which has two holes on both ends, for connecting the electric motor with Angklung;

vibrator plates, mounted on a pedestal of Angklung, which is equipped with a hook cam connected with another hole at one end of the vibrator arm;

electrical cables contained in the electric motor connecting the electric motor with the controller device, and controller device consisting of the controller driver and the flow controller as a track storage and control pulses of electric current to be supplied to the electric motor.

4. The apparatus for playing an Angklung musical instrument automatically as in claim 3, where the vertical poles, horizontal pole, and the bottom of the supporting frame made of metal, wood or other materials suitable for supporting frame.

5. The apparatus for playing an Angklung musical instrument automatically as in claim 3, where the vertical poles have different heights so that the horizontal pole which is attached to it seem skewed to the base on the Angklung can be aligned.

6. The apparatus for playing an Angklung musical instrument automatically as in claim 3, the bottom of the supporting frame can be closed by a cover made of wood or other suitable material.

7. The apparatus for playing an Angklung musical instrument automatically as in claim 3, where the electric motor produces more than 7 rounds of RPS (420 rpm) up to a maximum of 10 RPS (600 rpm).

8. The apparatus for playing an Angklung musical instrument automatically as in claim 6, where the electric motor produces rotation which is preferred more than 9 RPS (540 rpm).

9. The apparatus for playing an Angklung musical instrument automatically as in claim 3, where the distance of eccentric shaft against the midpoint of the eccentric disk is of between 1 mm to 5 mm.

10. The apparatus for playing an Angklung musical instrument automatically as in claim 3, where the distance of eccentric shaft against the midpoint of the eccentric disk is of 2.5 mm.

11. The apparatus for playing an Angklung musical instrument automatically as in claim 6, where the electric motor has an actuator housing to keep the electric motor does not move from its position.

12. The apparatus for playing an Angklung musical instrument automatically as in claim 6, in which the number of electric motors mounted on the actuator supporting frame is equal to the number of Angklungs contained in the instrument.

13. The apparatus for playing an Angklung musical instrument automatically as in claim 3, where the hanging pole has supporting segments to keep the Angklungs remained in place.

14. The apparatus for playing an Angklung musical instrument automatically as in claim 3, where the controllers consists of a series of microcontroller PIC, an optocoupler, and mosfet.

15. The apparatus for playing an Angklung musical instrument automatically as in claim 3, where the controllers consists of a series of microcontroller PIC preferably used PIC 16F877A type, optocoupler preferably used 4N28 type, and mosfet preferably used IRFZ44N type.

16. The apparatus for playing an Angklung musical instrument automatically as in claim 3, where the controllers equipped with a serial port; screen viewer in the form of LCD screens, and three buttons namely: the reset button, the power button, button 1 and button 2.

17. The apparatus for playing an Angklung musical instrument automatically as in claim 3, where the controllers can be placed at the bottom of the supporting frame or separated from the device to play an Angklung instrument automatically.

18. A system to play an Angklung musical instrument automatically comprising:

a hardware comprising, more than one Angklung, supporting frames where Angklungs and actuators are placed, an actuator including an electric motor having an eccentric disk mounted on a motor shaft, the eccentric disk having an eccentric shaft that is connected with an Angklung via a vibrator arm, the actuator further including a cable to connect it to the controller device, a controller device equipped with electronic components, power source, which serves to save the song and regulate the electric current to the actuator, and a computer device to facilitate the downloading, removal, writing and editing songs which is optionally connected to the controllers; and a software that is installed on a computer comprising;

an interface program to download, remove, save or record the songs stored on the controller device, and other programs to write songs, where the actuator is connected with a series of controller, which has recorded songs in the form of data of electronic text which is then translated into a series of commands on the controller to adjust the pulse of electrical current that drives the actuators.

* * * * *